United States Patent [19]

Jones

[11] Patent Number: 4,546,976

[45] Date of Patent: Oct. 15, 1985

[54] REINFORCED PLASTIC BASEBALL BAT WITH SEPARATE HANDLE SECTION

[75] Inventor: Thomas N. Jones, Ann Arbor, Mich.

[73] Assignee: Renosol Corporation, Ann Arbor, Mich.

[21] Appl. No.: 576,687

[22] Filed: Feb. 3, 1984

[51] Int. Cl.[4] ..... A63B 59/06

[52] U.S. Cl. ..... 273/72 R; 273/DIG. 8

[58] Field of Search ..... 273/72 A, 72 D, DIG. 8

[56] References Cited

U.S. PATENT DOCUMENTS 2,340,156 1/1944 Taylor et al. ..... 273/72 R 4,032,143 6/1977 Mueller ..... 273/72 R

*Primary Examiner*—William H. Grieb

*Attorney, Agent, or Firm*—Stephenson and Boller

[57] ABSTRACT

A baseball bat comprising a hollow metal core of varying diameter and a foam plastic body enveloping the core. The plastic body has a handle section and a hitting section that are separately molded so that said handle section is softer than said hitting section and can be of a different color when desired.

4 Claims, 3 Drawing Figures

REINFORCED PLASTIC BASEBALL BAT WITH SEPARATE HANDLE SECTION

BACKGROUND OF THE INVENTION

The present invention relates generally to baseball bats of the type shown in U.S. Pat. No. 4,032,143, wherein a plastic body encloses a hollow metal core. In general, the composite bat eliminates the problem of breakage to which wooden bats are susceptible while maintaining a weight comparable to the weight of wooden bats. The composite bat is, however, subject to objection because it must have a hand grip applied to the handle, and vibration of the metal core caused by contact of the bat against a pitched ball can readily sting the batter's hands. It is an object of the present invention, therefore, to provide an improved composite bat which has a separately molded handle section which can be a softer plastic that reduces stinging of the batter's hands and can be adapted to a variety of special characteristics such as color.

SUMMARY OF THE INVENTION

The present invention provides a baseball bat which has a hollow metal core, the diameter of which varies along the length of the bat, and a foam plastic body which envelops the core. The plastic body has a handle section and a hitting section. The diameter of the core is greatest at the hitting end of the bat and least at the handle end. The plastic body is molded to conform to the shape of conventional baseball bats.

By dividing the plastic in the bat into hitting and handle sections, the handle section including the knob at the small end of the body, the plastic can be adapted to the function it is to perform. Thus, a high density foam plastic may be used in the hitting section to more adequately resist deformation on impact and absorb less of the force of impact. The bat therefore produces sharp hits.

The handle section can be formed of a lower density and/or soft elastomcric foam that will absorb impact and prevent stinging of the batter's hands. The resilient handle section material enables the batter to grip the bat more firmly and the soft knob on the handle prevents injuries to players accidentally struck by bats.

The fact that the handle section material is a different plastic from the hitting section also enables these sections to be molded in contrasting colors, which is very desirable. Currently, black bats with white handle sections are in demand. The bat of this invention eliminates the need for applying a separate grip to the handle; it can be molded initially in the desired color. Also, the foam plastic formulation can be varied, if desired, to make the handle section sticky or tacky to facilitate the batter's grip, and the mold can be configured to provide a design or rough texture to the handle surface.

The invention thus provides an improved baseball bat which is lightweight, easy to manufacture, won't sting the batter's hands and is adaptable to a variety of special situations relating to bat handles. The improved metal core enables the bat to produce sharper hits while reducing the stinging effect of impact.

Further objects, features and advantages will become apparent, and the invention understood more fully, from a consideration of the following description, the accompanying drawings, and the appended claims.

DESCRIPTION OF THE INVENTION

Figure 1:
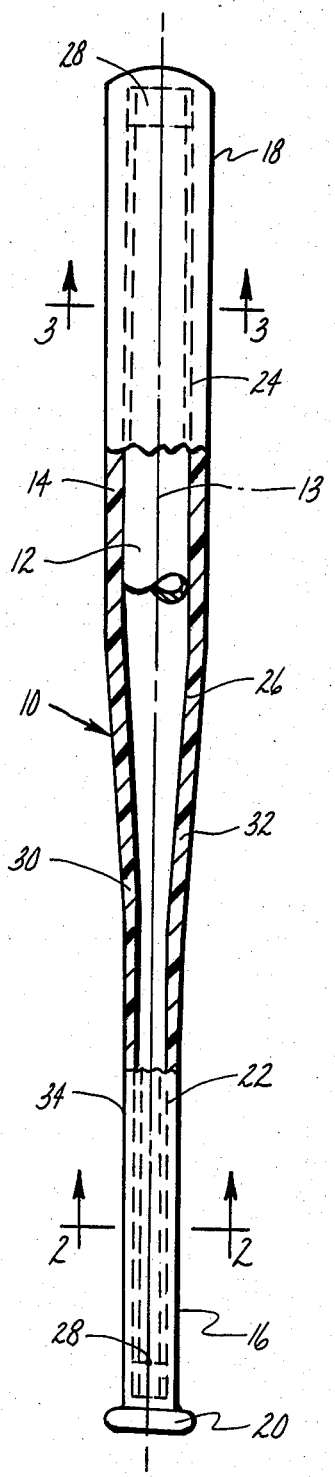
FIG. 1 is a side view, partially in section, of a baseball bat constructed in accordance with this invention.

The baseball bat of this invention, indicated generally at 10 in the drawing, comprises a hollow metal core 12 having a longitudinal axis 13 and a plastic body 14, formed of a suitable structural foam plastic such as urethane, envelops and is co-axial with the core 12. The body 14 has a shape which conforms generally to the shape of a conventional baseball bat. As seen in FIG. 1, the body 14 has a handle or gripping end section 16 and a striking or hitting end section 18. The cross sectional shape of the body 14 at any point along its length is generally circular, and the diameter of the body 14 is substantially greater at the striking end than at the gripping end. A plastic knob 20 is provided at the end of the handle section 16.

Figure 3:
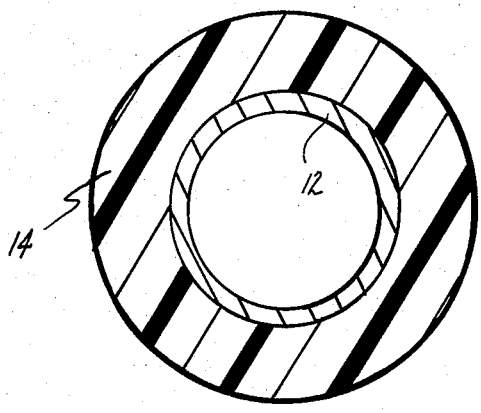
FIG. 3 is an enlarged cross sectional view as seen from substantially the line 3—3 in FIG. 1.
Figure 2:
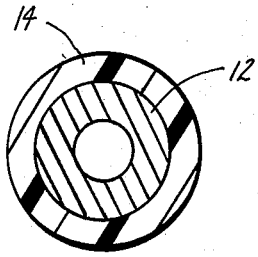
FIG. 2 is an enlarged cross sectional view of the baseball bat of this invention, as seen from substantially the line 2—2 in FIG. 1.

The diameter of the core 12 varies along the length of the bat. The diameter is greatest at the striking end and least at the gripping end. The core 12 may be circular in cross section, as seen in FIGS. 2 and 3, or it may take alternative forms. Any alternative shape is suitable, as long as the cross section is symmetrical about lines passing through its center in the plane of the cross section.

The invention also provides a core 12 in which the amount of metal per unit diameter is greater in the handle section than in the hitting section so that stinging of the batter's hands is reduced. This can be accomplished by forming the core 12 so that its wall thickness varies from a minimum at the striking end to a maximum at the gripping end.

In one embodiment of this invention, the core 12 has three sections: a first end section 22 which corresponds to the handle section 16 of the plastic body 14, a second end section 24 which corresponds to the hitting section 18 of the body 14, and an intermediate section 26 which extends between the end sections 22 and 24. In the first end section 22, the thickness and diameter of the core 12 are constant. For example, the thickness may be approximately 0.160 inches and the diameter approximately 0.900 inches. In the second end section 24, the thickness and diameter are likewise constant, but at different values. The thickness may be approximately 0.083 inches and the diameter approximately one and one-half inches, for example. (It is to be understood that numerical values used herein are for illustrative purposes only, and that the core 12 may assume dimensions other than those indicated.) In the intermediate section 26, the thickness and diameter vary, as a function of distance from the end of the bat, between their values at the end sections 22 and 24.

The baseball bat 10 is formed as follows. First, a metal tube is selected which has a thickness and diameter equal to the thickness and diameter desired of the second end section 24. The initial shape of the tube may be circular, polygonal, or otherwise as desired. The tube is typically aluminum, but other metals, such as titanium and magnesium, are also suitable. The length of the tube should be slightly less than the desired length of the bat 10, thus typically about thirty to thirty-four inches. In forming the intermediate section 26 and the first end section 22, the length of the tube is held constant while the surface is decreased by applying pressure to the outer surfaces of the sections 26 and 22. The reduction in diameter correspondingly causes either an increase in wall thickness or an increase in the cross sectional area of the core metal per unit circumference. The core 12 may be fashioned to the desired shape using one or more of a variety of processes including swaging, stamping, and crimping.

After the core 12 has been formed, plugs 28 are placed in the ends thereof and the core 12 is placed into a mold. Plastic foam, such as a rigid urethane foam, is then injected into the mold so that it adheres to the surface of the core 12 and forms the portion 32 of the plastic body 14 that constitutes the hitting section of the bat 10. This portion 32 of the body 14 terminates at the line 30 where the handle section 16 starts.

The portion 34 of the body 14 corresponding to the handle section 16 is then molded. A flexible microcellular urethane foam is preferably used to form the body portion 34. A similar flexible elastomeric material could also be used. The body portion 34 is made soft either by virtue of the composition and inherent characteristics of the foam material from which it is formed or by virtue of its being less dense than the portion 32, or a combination of both reasons. As shown in FIG. 1, the knob 20 is beyond the end of the core 12 so it is totally formed of plastic. The plugs 28 prevent the foam from filling the interior of the core 12. The knob 20 is soft and molded integrally with the body portion 34 so that it can't injure anyone.

The invention thus provides an improved baseball bat 10 having a two-part plastic body 14 and a hollow metal core 12 of varying thickness and diameter. The body portion 32 is a dense hard structural foam material capable of producing sharp hits off the bat 10. The portion 34 is a softer foam material which can be firmly gripped by the batter and which dampens vibrations in the bat 10 when a ball is hit. Preferably, the portion 34 is also formed of a material which is of a different internally molded color than the portion 32.

What is claimed is:

1. A baseball bat comprising a hollow metal core extending substantially the length of the bat and a plastic body enveloping said core and having the shape of a conventional baseball bat so that it has a handle section which is of a length to accomodate the hands of a batter gripping the bat and a hitting section which is of a larger diameter and is intended for striking a ball, said hitting section being separate from said handle section, said hitting section and said handle section being separately formed of materials having different characteristics, said handle section being formed of a soft foam material that will dampen vibrations in the bat when a bat is hit, and said hitting section being formed of a dense hard structural foam material.

2. The baseball bat according to claim 1, wherein said plastic body is molded on said core and said handle section is a different internally molded color than said hitting section.

3. The baseball bat according to claim 1, wherein said handle section terminates in a knob which extends beyond said core and is integrally molded with said handle section of said body.

4. The baseball bat according to claim 1 wherein said core is of varying cross sectional diameter, said core being of smaller diameter in said handle section than in said hitting section.

* * * * *